US005912606A

United States Patent [19]

Nathanson et al.

[11] Patent Number: 5,912,606

[45] Date of Patent: Jun. 15, 1999

[54] MERCURY WETTED SWITCH

[75] Inventors: Harvey C. Nathanson, Pittsburgh; Thomas J. Smith, Jr., Greensburgh; Carl B. Freidhoff, Murrysville, all of Pa.; F. William Hopwood, Severna Park; James E. Degenford, Ellicott City, both of Md.; J. Douglas Adam, Murrysville, Pa.

[73] Assignee: Northrop Grumman Corporation, Los Angeles, Calif.

[21] Appl. No.: 09/135,747

[22] Filed: Aug. 18, 1998

[51] Int. Cl.[6] ..... H01H 29/00

[52] U.S. Cl. ..... 335/47; 335/57; 335/58; 200/233

[58] Field of Search ..... 335/47, 48, 49, 335/50, 51, 52, 53, 54, 55, 56, 57, 58; 200/233, 234, 235, 192, 193

[56] References Cited

U.S. PATENT DOCUMENTS

| | | | |
|---|---|---|---|
| 2,312,672 | 3/1943 | Pollard, Jr. | 335/58 |
| 3,144,533 | 8/1964 | Donath | 335/47 |
| 3,198,919 | 8/1965 | Tettke, Sr. et al. | 335/58 |
| 3,906,415 | 9/1975 | Baker | 335/47 |

*Primary Examiner*—Lincoln Donovan
*Attorney, Agent, or Firm*—Walter G. Sutcliff

[57] ABSTRACT

A switch having spaced apart conductors with a high resistivity gate member therebetween. First and second mercury droplets are respectively connected to the ends of the conductors. When a control signal is applied to the gate member, the mercury droplets are drawn to it and establish electrical connection between the conductors to close the switch. Upon removal of the control signal the mercury droplets separate and assume their initial droplet form thus opening the switch.

12 Claims, 12 Drawing Sheets

MERCURY WETTED SWITCH

BACKGROUND OF THE INVENTION

1. Field of the Invention

The invention in general relates to miniature switches and more particularly to a switch useful in microelectromechanical systems.

2. Description of Related Art

A variety of devices exist for controlling propagation of signals in DC as well as RF circuits. For example, electronic RF switches in common use include the gallium arsenide (GaAs) field effect transistor (FET) and the GaAs pin diode. Both of these devices operate at extremely high speeds and can achieve switching rates measurable in nanoseconds.

For some applications however, the GaAs FET has an objectionably high resistance when closed and a relatively low cut-off frequency, for example, 600 GHz. The pin diode exhibits a higher cut-off frequency of around 2 THz, however it, along with the GaAs FET, exhibits an objectionably high capacitance in the off state. For this reason these RF switches are usually operated with a separate shunt inductor resonant with the capacitance, at the operating frequency.

This added inductor advantageously increases the impedance of the switch in the off condition, however this arrangement objectionably lowers the operating bandwidth of the overall switch device.

With the present invention, the electromechanical mercury wetted switch operates at a slower speed than the all electronic variety, however the switching rate, measurable in microseconds, is still more than adequate for many intended purposes.

Further, the switch of the present invention has a significantly lower capacitance in the off state and has a lower resistance in the on state of operation resulting in a cut-off frequency of several hundred THz.

SUMMARY OF THE INVENTION

A mercury wetted switch is provided which includes first and second conductors which are adjacent but separated from one another with a gate member disposed between the conductors. A first mercury droplet is in electrical contact with the first conductor and a second mercury droplet is in electrical contact with the second conductor.

Means are provided for applying a control signal to the gate member causing the first and second mercury droplets to move toward the gate member and toward one another to establish electrical connection, either directly or by capacitive coupling, between the first and second conductors, rendering the switch on, as long as the control signal is applied.

Upon removal of the control signal the first and second mercury droplets separate to their initial positions thereby breaking electrical contact between the first and second conductors, rendering the switch off.

DESCRIPTION OF THE PREFERRED EMBODIMENT

Figure 1A:
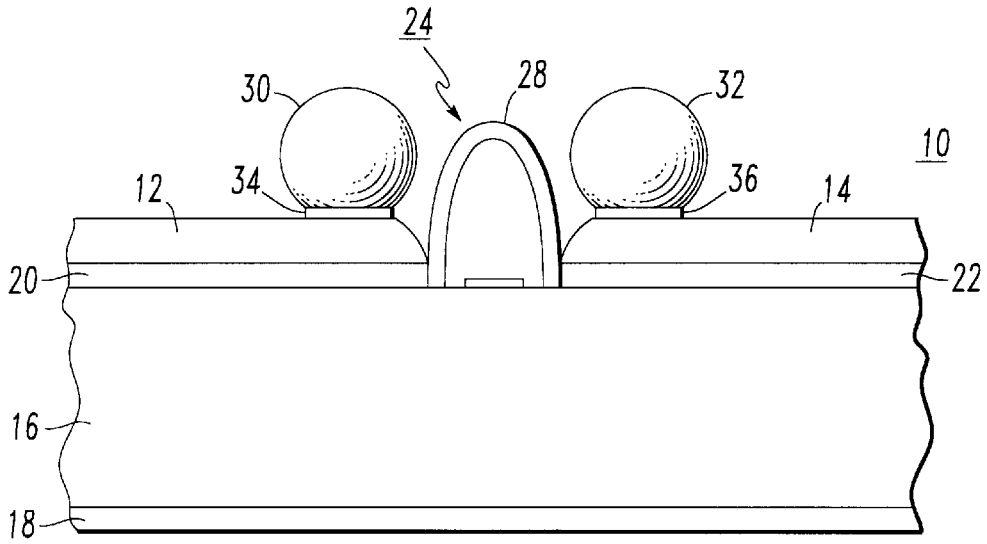
FIGS. 1A and 1B are respective side and perspective views of a switch, in accordance with the present invention, shown in the open condition.

In the drawings, which are not necessarily to scale, like or corresponding parts are denoted by like or corresponding reference numerals.

Figure 1B:
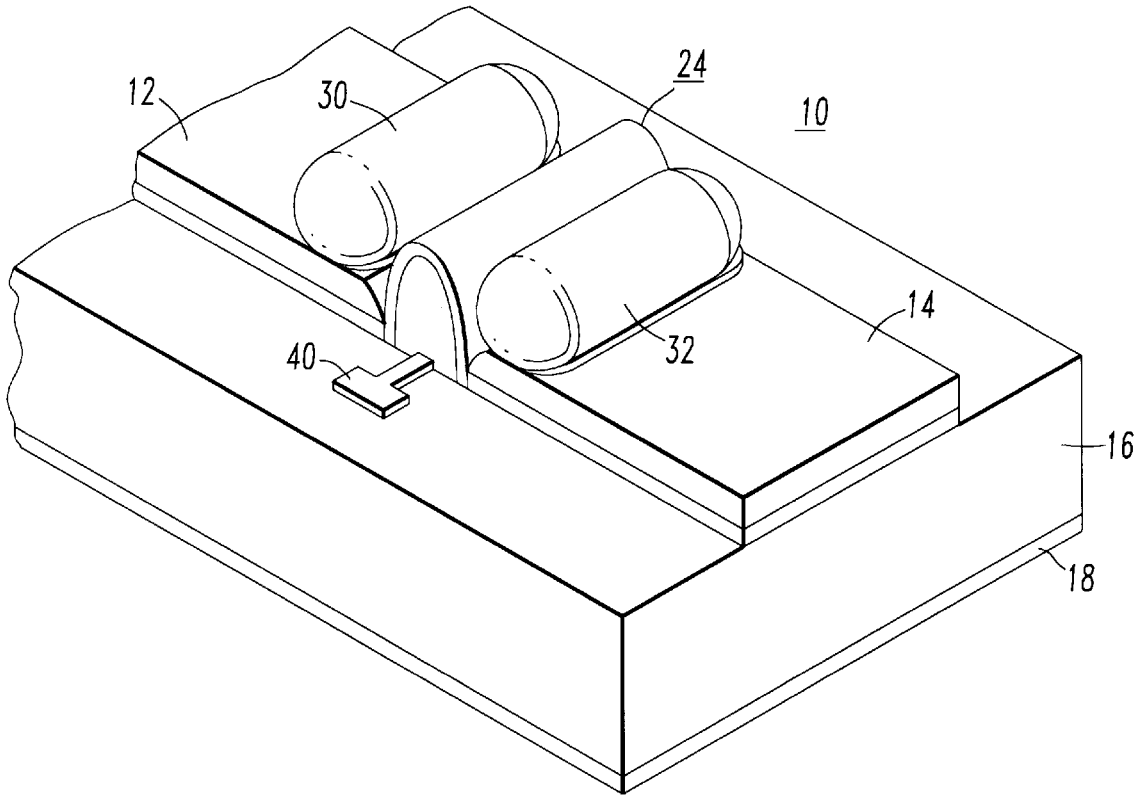

Referring now to FIGS. 1A and 1B, in accordance with the present invention, there is illustrated switch 10 having first and second conductors 12 and 14 affixed to a substrate 16, such as alumina. Although the switch is applicable to DC circuits, it will be described, by way of example, with respect to an RF circuit, and accordingly, the conductors 12 and 14 represent a 50 ohm characteristic impedance RF microstrip line, with a ground plane 18 positioned on the other side of substrate 16. Titanium/gold base layers 20 and 22 may be utilized for better adhesion of the conductors 12 and 14 to the substrate 16.

Conductors 12 and 14 are adjacent but separated from one another so that no electrical contact is made between them. A gate member 24 is disposed between the conductors 12 and 14 at the respective ends thereof, and includes a dielectric oxide coating 28 on the surface thereof. The gate member 24 is electrically conductive but has a high resistivity to prevent RF conduction and may be constituted by a polysilicon material. The oxide coating 28 may be silicon dioxide, or any other suitable coating such as silicon nitride, or silicon oxynitride, by way of example.

The switch includes respective first and second mercury droplets 30 and 32 which are elongated and electrically connected to respective conductors 12 and 14 by means of bonding layers, or pads, 34 and 36. These bonding layers 34 and 36 are of a material, such as silver, to cause the mercury droplets to be held in place by wetting action. Other bonding materials include, for example, chromium, vanadium, niobium, molybdenum, tantalum and iridium.

During operation, the RF microstrip conductors 12 and 14 are maintained at ground potential at DC or at the low frequency associated with control voltages applied to the gate member 24. A control electrode 40 electrically connected to gate member 24 is operable to receive a positive or negative DC control signal, relative to the mercury droplets 30 and 32, causing them to experience a lateral field to not only wet the oxide coating 28 but to pull the mercury droplets to the top of the gate member 24 where they may be physically joined, as illustrated in FIGS. 2A and 2B.

Figure 2A:
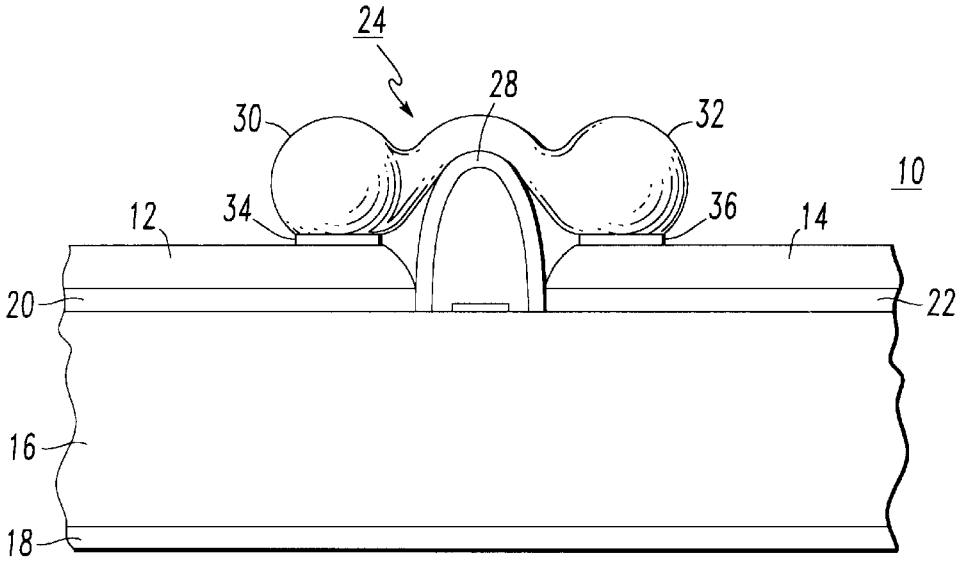
FIGS. 2A and 2B are respective side and perspective views of a switch, in accordance with the present invention, shown in the closed condition.
Figure 2B:
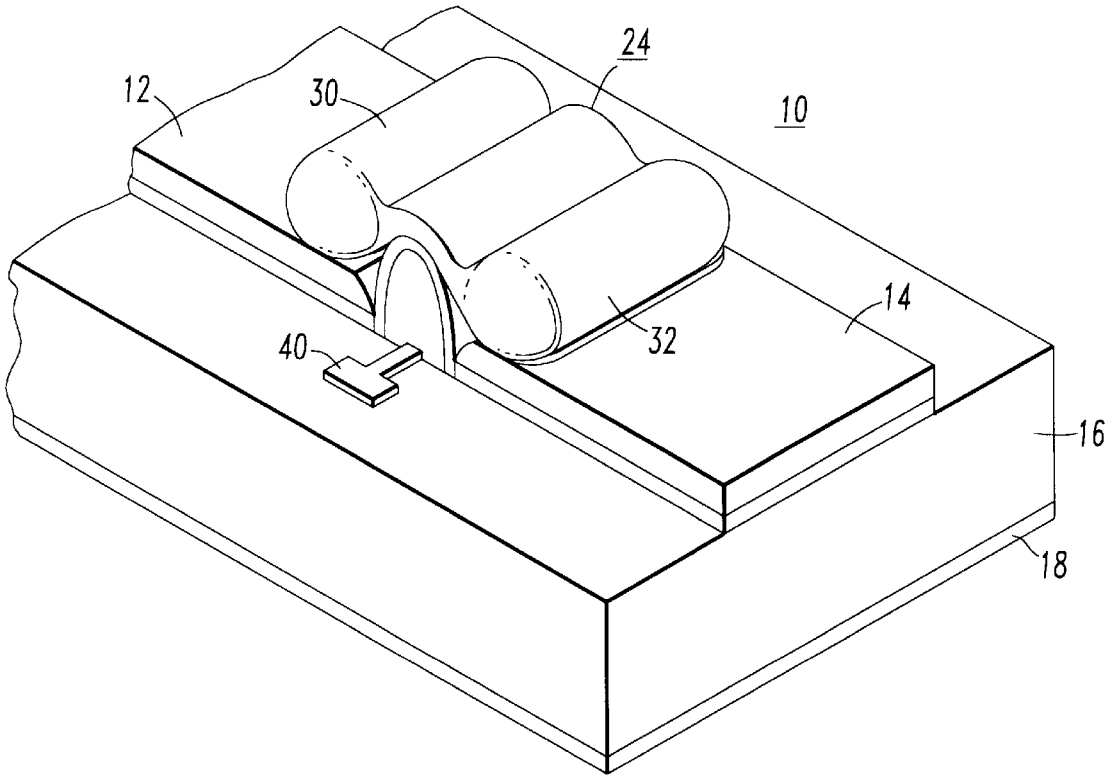

As seen in FIGS. 2A and 2B application of the control signal to electrode 40 causes wetting of the oxide coating 28 to the extent that the mercury droplets are now joined by a mercury bridge 42 and will remained joined as long as the applied control signal is present. Upon removal of the control signal the mercury droplets 30 and 32 will revert to their respective positions illustrated in FIGS. 1A and 1B.

Figure 3A:
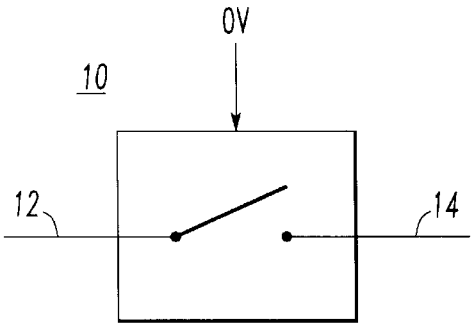
FIGS. 3A and 3B functionally illustrate the switch in its respective open and closed condition.
Figure 3B:
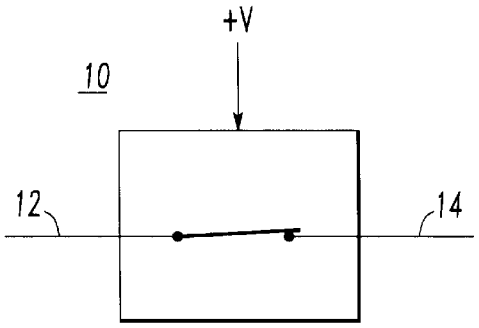

FIGS. 3A and 3B illustrate the functional operation of the switch. In FIG. 3A with no control signal applied, the switch 10 is in an open condition and no RF signal passes between the conductors 12 and 14. With the application of, for example, a positive DC control signal (+V) of a predetermined magnitude, as illustrated in FIG. 3B, the switch assumes a closed condition to allow propagation of the RF signal.

Figure 4A:
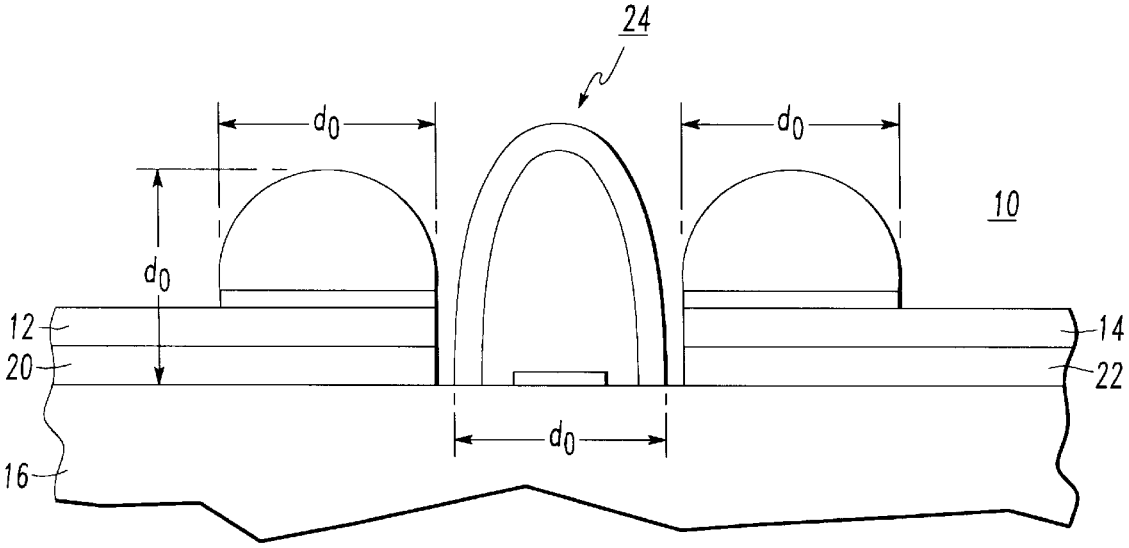
FIG. 4A illustrates some dimensions of the switch and FIG. 4B illustrates the electrical equivalent of the switch.

The predetermined magnitude of the control signal will depend upon the dimensions of the switch elements. By way of example, with reference to FIG. 4A, assume for the purpose of illustration that the microstrip conductors 12 and 14 have a characteristic impedance of 50 ohms with a width of 0.0254 cm (254 $\mu$m). Mercury droplets 30 and 32 each have a length (into the plane of the FIG.) equal to, or slightly less than the width of the microstrip line. Each mercury droplet has a width $d_o$, where $d_o$ is about 20 $\mu$m, which is approximately equal to its height as measured from the top of the droplet to the substrate 16. The width of the gate member 24, at its base is also assumed equal to $d_o$.

Figure 4B:
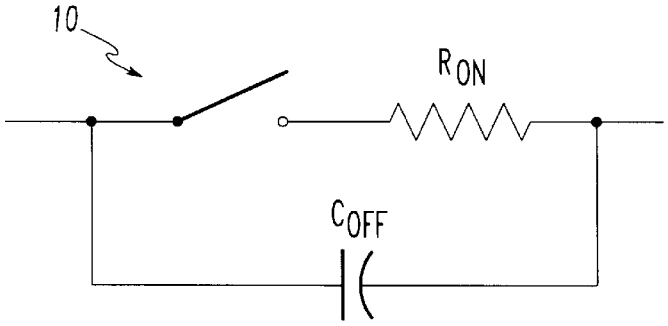

With these values a gate voltage on the order of 50 volts will suffice to close the switch when the oxide coating 28 is on the order of 1000 Å thick. Further, with these dimensions, and as illustrated in FIG. 4B, showing the electrical equivalent of the switch, the switch will have no significant inductance, an extremely low on resistance $R_{ON}$ on the order of 20 milliohms and a low off capacitance $C_{OFF}$ on the order of $2.5\times10^{-14}$ farads. These low values delineate the operating cutoff frequency $F_{CO}$, where:

$$F_{CO}=1/(2\pi\times R_{ON}\times C_{OFF}) \quad \text{eq (1)}$$

Substituting the $R_{ON}$ and $C_{OFF}$ values of 20 milliohms and $2.5\times10^{-14}$ farads into equation (1) yields an extremely high cutoff frequency of around 318 THz.

Figure 5A:
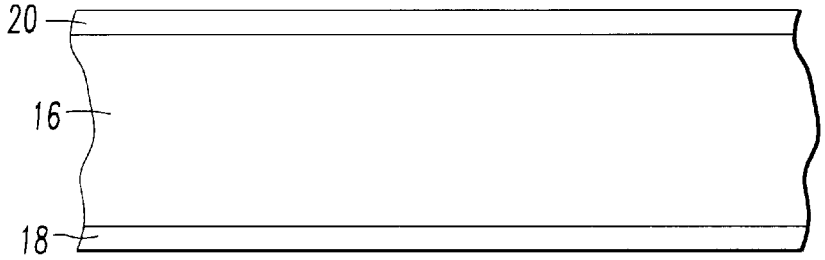
FIGS. 5A–5J illustrate the fabrication of the switch.
Figure 5B:
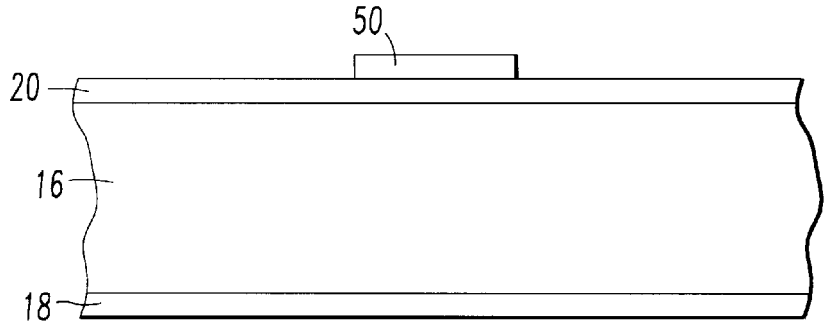
Figure 5C:
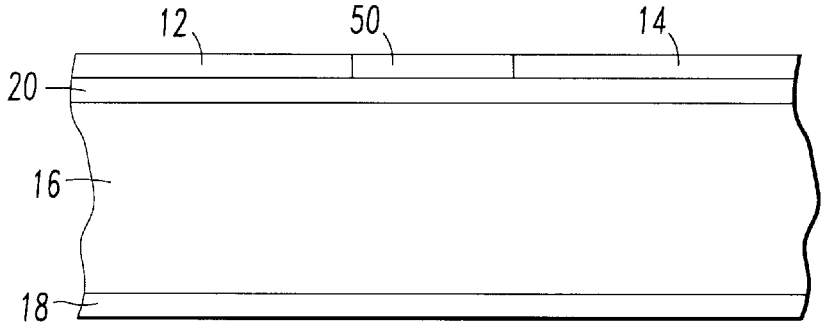

The structure of switch 10 lends itself to batch fabrication. FIGS. 5A through 5J illustrate one such process. In FIG. 5A the titanium and gold layer 20 has been applied to the top of substrate 16, and ground plane 18 been applied to the bottom thereof. A separator 50, as illustrated in FIG. 5B, is deposited, such as by photolithographic methods, after which the separated microstrip conductors 12 and 14 are plated, as in FIG. 5C.

Figure 5D:
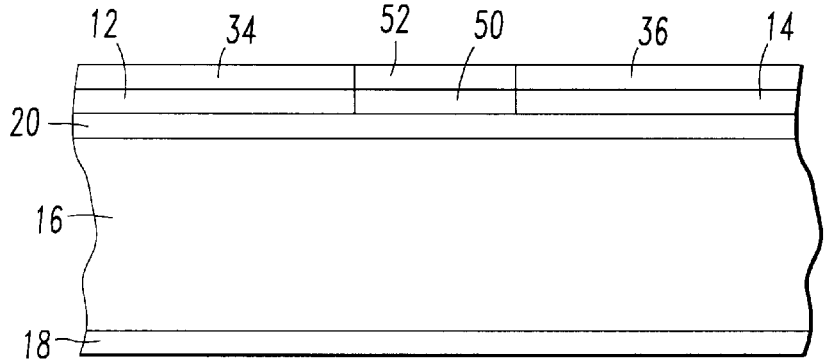
Figure 5E:
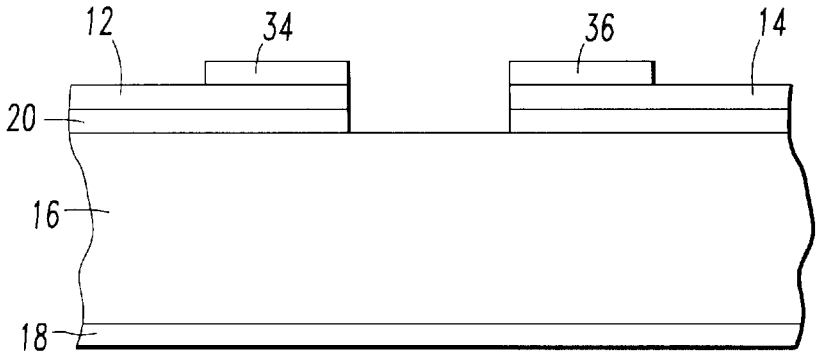

In FIGS. 5D and 5E another separator 52 is formed, and bonding layers 34 and 35 are evaporated on the microstrip conductors after which the bonding layers 34 and 36 are etched to the proper size and the separators are removed, as well as the titanium/gold layer underlying the separators.

Figure 5F:
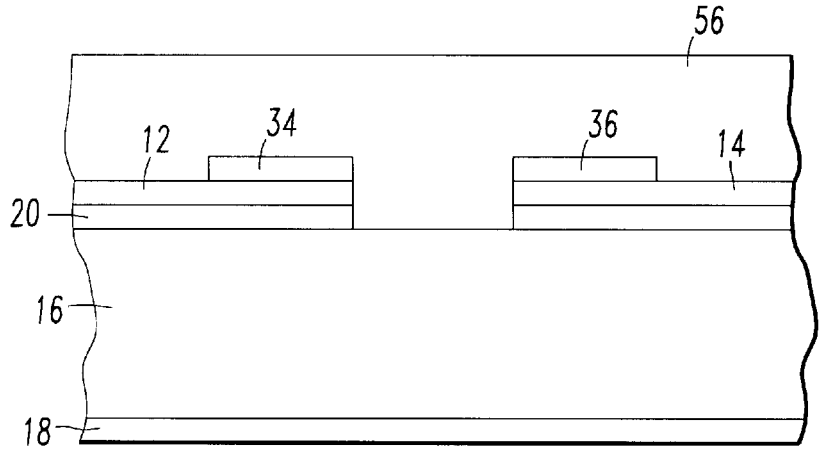
Figure 5G:
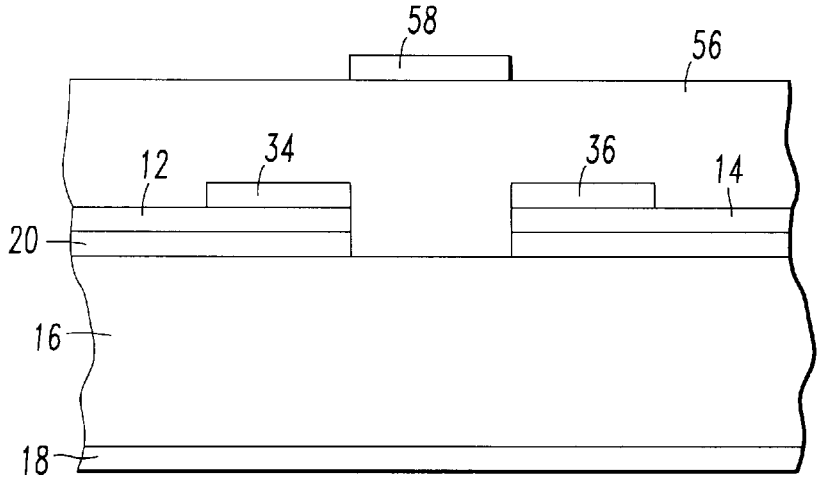

In the next step, as illustrated in FIG. 5F, about 20 $\mu$m of high resistivity polysilicon 56 is sputtered on and a photoresist 58 is applied, as in FIG. 5G. By a vertical reactive-ion dry-etch process the gate member 24 is formed. The photoresist 58 is removed, the gate member etched and thereafter anodized to form the oxide coating 28, all of which is depicted in FIG. 5H.

Figure 5H:
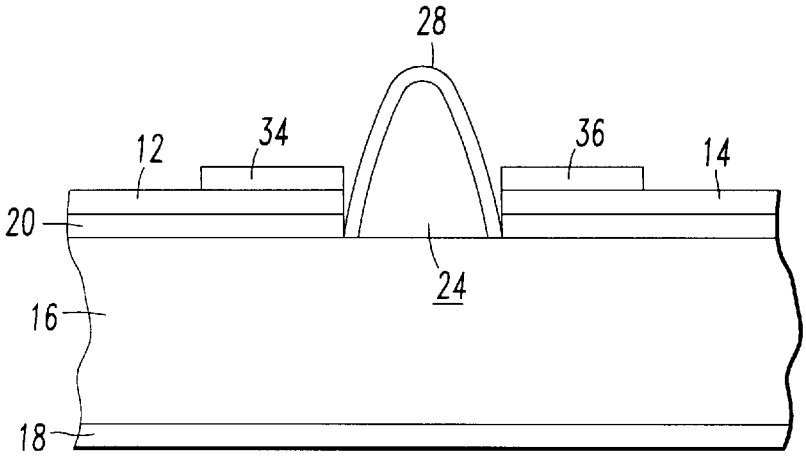
Figure 5I:
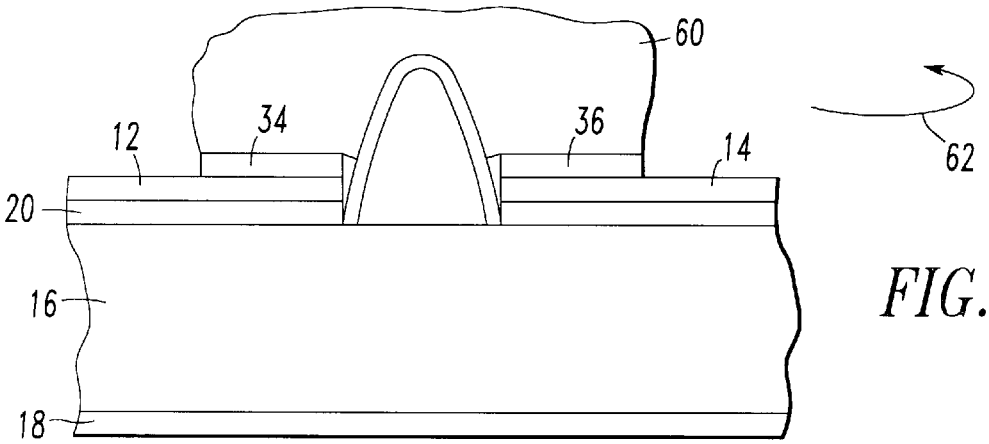
Figure 5J:
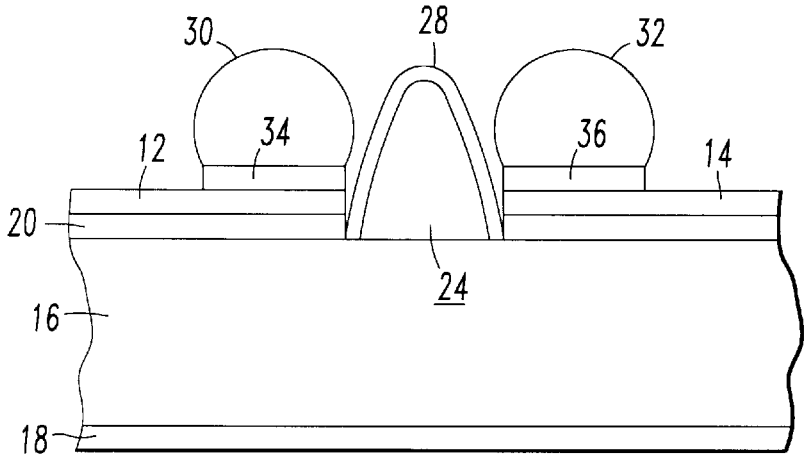

The structure of FIG. 5H is dipped into a mercury bath and removed, leaving a body of mercury 60 clinging to the bonding layers 34 and 36 and over the gate member 24. This is illustrated in FIG. 5I. The structure with the excess mercury is spun, as indicated by arrow 62, at about 300 rpm whereby the excess mercury is removed, leaving the well defined mercury droplets 34 and 36 as in FIG. 5J. If desired, the excess mercury removal may also be accomplished by electric field stripping wherein an electric field between an anode and the body of mercury pulls away the excess mercury until, as the cross section approaches 1:1, the mercury becomes stiff enough to resist further removal by field stripping.

Another mercury deposition method includes vacuum evaporation of mercury onto a substrate using photoresist to aid in selective deposition of the mercury onto the bonding layer. Suitable dielectric materials may serve the role of the photoresist.

Figure 6A:
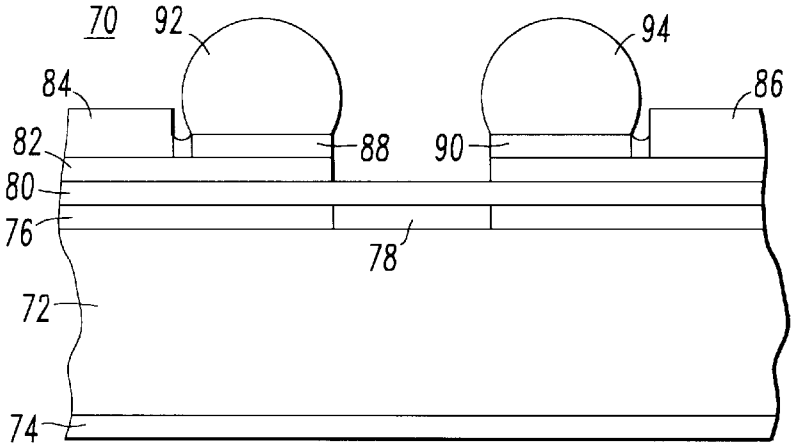
FIGS. 6A and 6B illustrate another embodiment of the present invention.
Figure 6B:
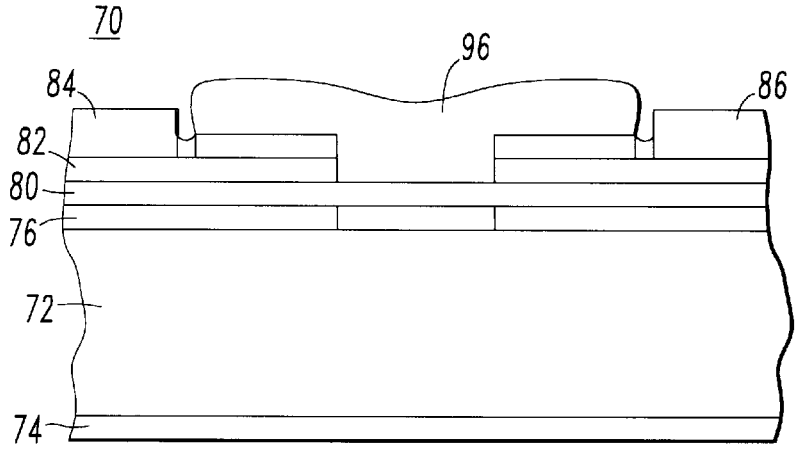

FIGS. 6A and 6B illustrate another embodiment of the invention which is simpler to fabricate and has an even lower value of off capacitance than that previously described, resulting in a higher cut off frequency. Switch 70 includes a substrate 72, having a ground plane 74 on the bottom side thereof and a high sheet resistivity polysilicon layer 76 on the top side. A portion of this layer is given a localized lower resistivity, such as by diffusion, to form a gate member 78.

A dielectric layer 80, such as a oxynitride, covers polysilicon 76, and this dielectric layer receives a titanium/gold base layer 82 to which is applied first and second microstrip conductors 84 and 86. Also applied to the titanium/gold base layer 82 are respective bonding layers, or pads, 88 and 90 for receiving respective mercury droplets 92 and 94.

In the absence of an applied control signal to gate member 78, the mercury droplets 92 and 94 are as illustrated in FIG. 6A such that switch 70 is in an open condition with no RF conduction between conductors 84 and 86. With the application of a suitable control signal to gate member 78, as illustrated in FIG. 6B, the mercury droplets are drawn toward the gate member 78 and contact one another forming a unitary mass of mercury 96 electrically contacting both conductors 84 and 86, thus closing the switch. When the control signal is removed, the mercury withdraws from the dielectric layer 80 and again assumes the configuration shown in FIG. 6A.

Figure 7A:
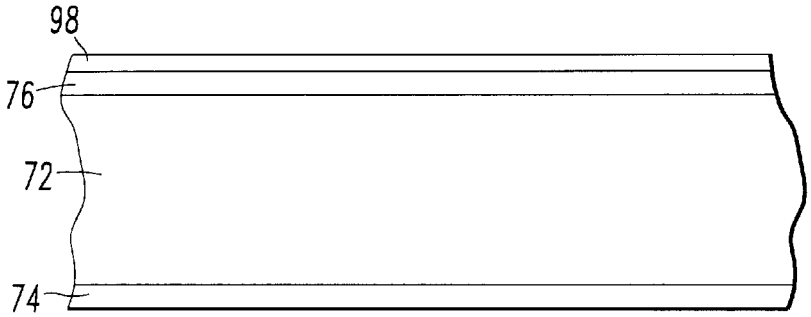
FIGS. 7A–7G illustrate the fabrication of the embodiment of the switch shown in FIGS. 6A and 6B.

One fabrication technique for this second switch embodiment is illustrated in FIGS. 7A through 7G. In FIG. 7A, a substrate member 72, having a ground plane 74, has applied to the exposed surface thereof the polysilicon layer 76. A temporary protective oxide coating 98 is deposited on the polysilicon layer 76 by deposition or by oxidizing the surface of the polysilicon.

Figure 7B:
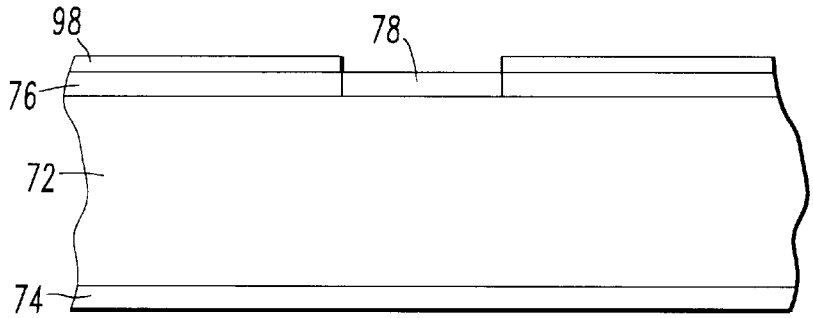

In FIG. 7B the oxide coating 98 has been opened and a diffusion or ion implantation process decreases the resistivity of the polysilicon layer in a limited area, to define the gate member 78.

Figure 7C:
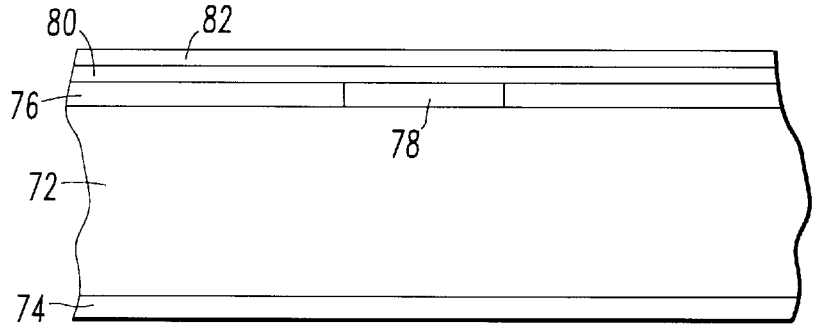
Figure 7D:
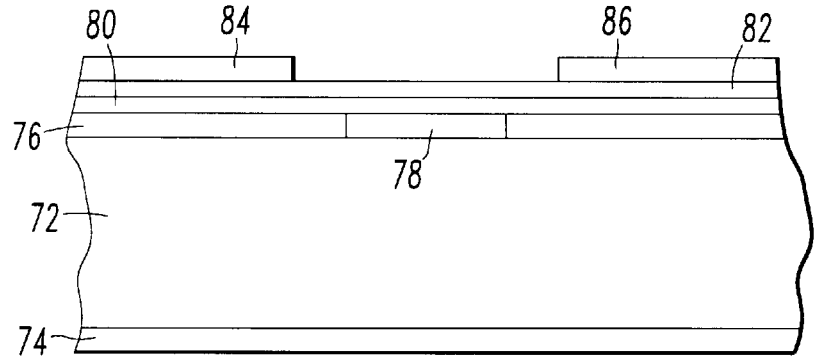

In FIG. 7C, the first oxide coating 98 is removed and the dielectric oxynitride layer 80 is applied, as is titanium/gold layer 82 for receiving the conductors 84 and 86, as illustrated in FIG. 7D. The conductors 84 and 86 may be plated on the titanium/gold layer 82 with the use of a photoresist, which has already been removed in FIG. 7D.

Figure 7E:
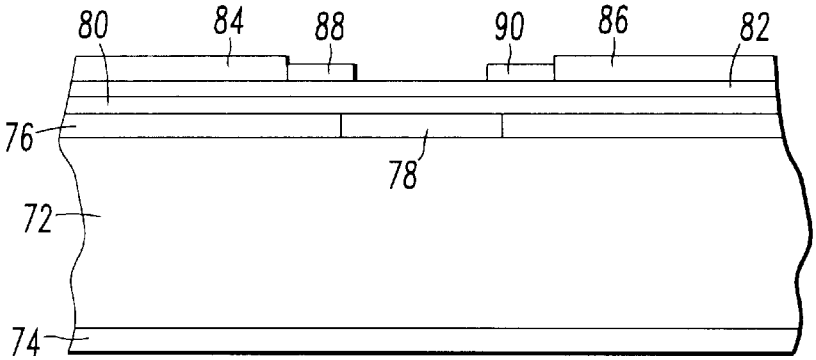
Figure 7F:
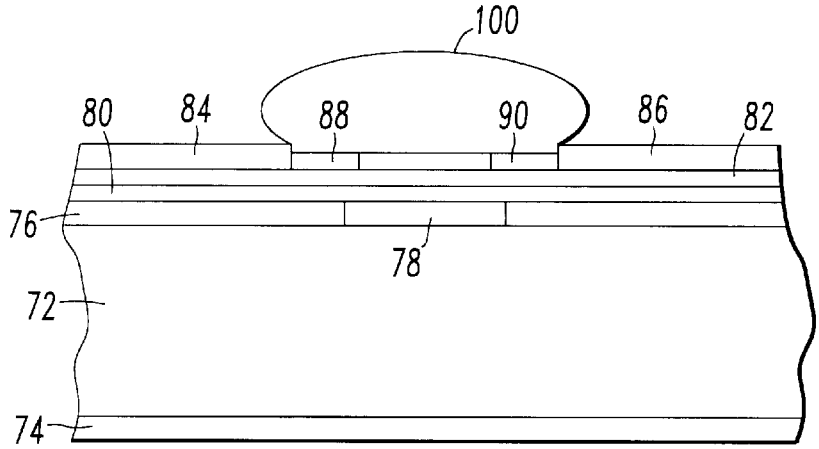
Figure 7G:
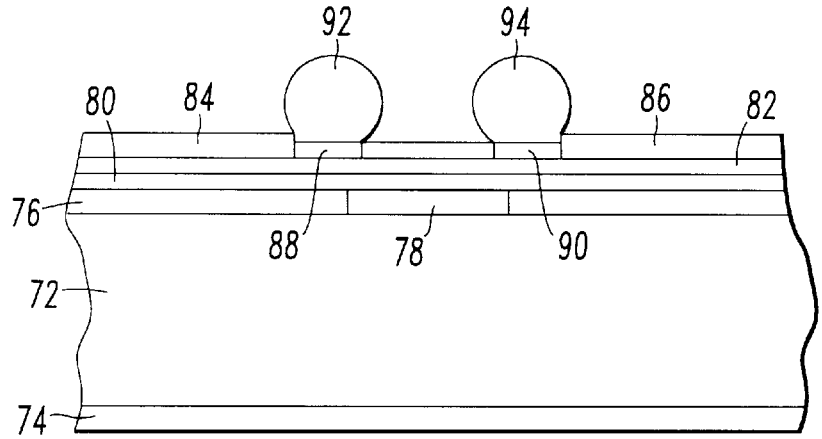

In FIG. 7E, mercury droplet bonding pads 88 and 90 are evaporated onto the titanium/gold layer 82 and the middle section of this layer is removed leaving an exposed portion of dielectric layer 80 between the pads 88 and 90. The structure of FIG. 7E is dipped into a mercury bath and removed, as illustrated in FIG. 7F, leaving a body of mercury 100 clinging to the bonding layers 88 and 90 as well as to the dielectric over the gate member 78. Excess mercury may be removed by one of the aforementioned spin or field stripping processes leaving the switch structure of FIG. 7G.

Direct vacuum evaporation of mercury onto the pads may also be accomplished.

Although not illustrated, after fabrication the switch or switches may be placed in a hermetically sealed container filled with an inert gas, such as argon, prior to use. This container can either be external, or an integrally constructed configuration relative to the switch. The mercury wetted switch of the present invention finds applicability in a variety of microwave systems, a sample one of which is illustrated in FIG. 8.

Figure 8:
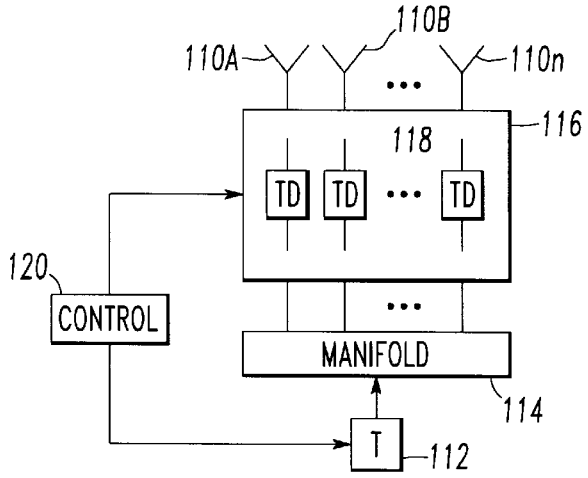
FIG. 8 is a block diagram of an overall system in which the present invention finds an application.

FIG. 8 is a simplified representation of the transmitter function of a radar system having a plurality of antenna elements 110A, 110B . . . 110*n*. A transmitter 112 provides an RF signal to be transmitted, to a manifold circuit 114 which distributes the signal to the plurality of antenna elements. A transmitter beam, or a plurality of such beams may be formed and steered, with the provision of a delay circuit 116 comprised of a plurality of time delay units 118, and all being governed by a control means 120. In a similar manner, receiver beams may be formed and steered utilizing similar delay units.

Figure 9:
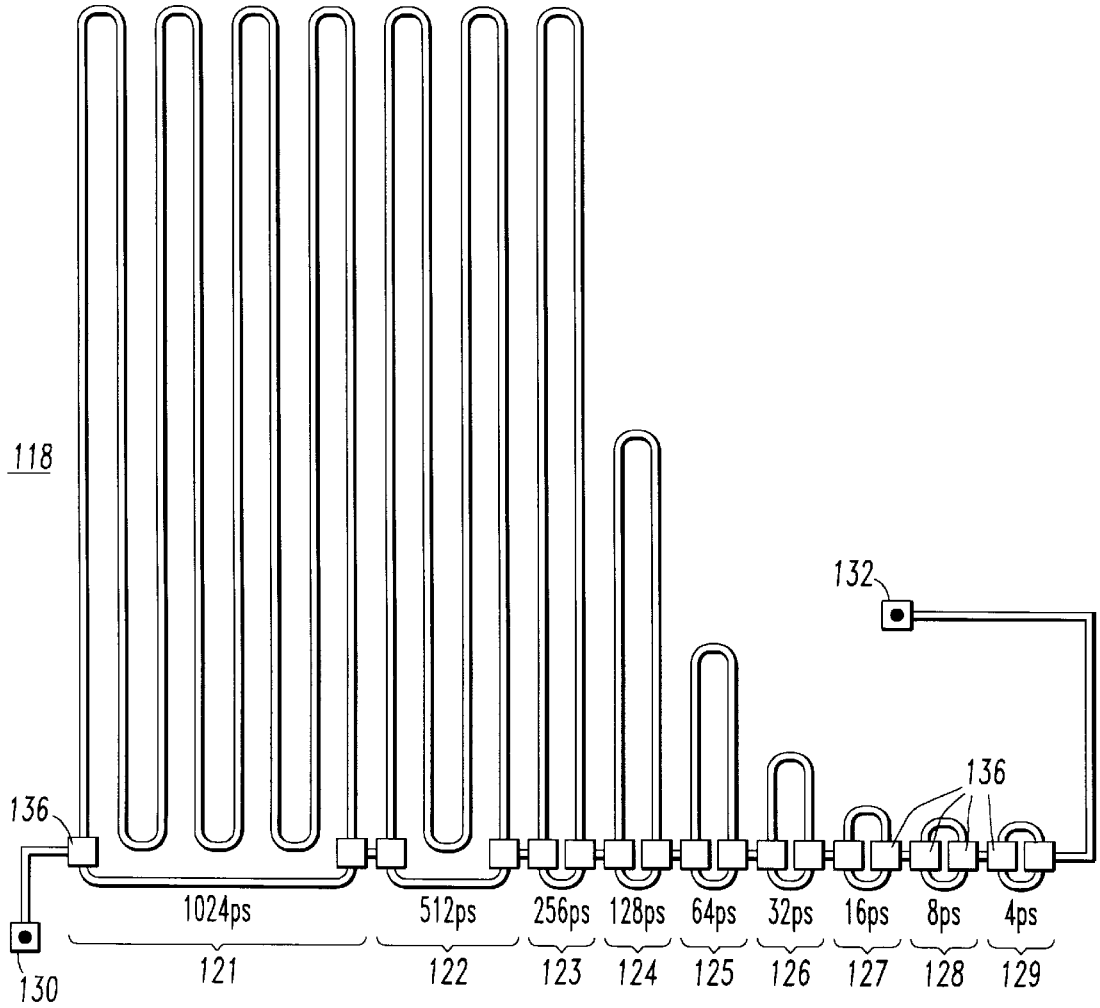
FIG. 9 illustrates a time delay circuit of FIG. 8 in more detail.

A typical time delay unit 118 is illustrated in more detail in FIG. 9. The time delay unit 118 includes nine stages of delay, 121–129 which, when selectively placed into the signal path, can control the relative time delay of a signal applied to input terminal 130, from 0 ns to 2.048 ns in 4 ps increments, until the signal appears at output terminal 132.

From FIG. 9 it is seen that stage 121 is capable of a 1024 ps delay, with delays of 512 ps, 256 ps, 128 ps, 64 ps, 32 ps, 16 ps, 8 ps, and 4 ps being provided by respective stages 122–129. The selection of the particular stages to be in the signal path is governed by inclusion of single pole, double throw mercury wetted switch arrangements utilizing the principles described herein, and identified by reference characters 136 in FIG. 9.

Figure 10:
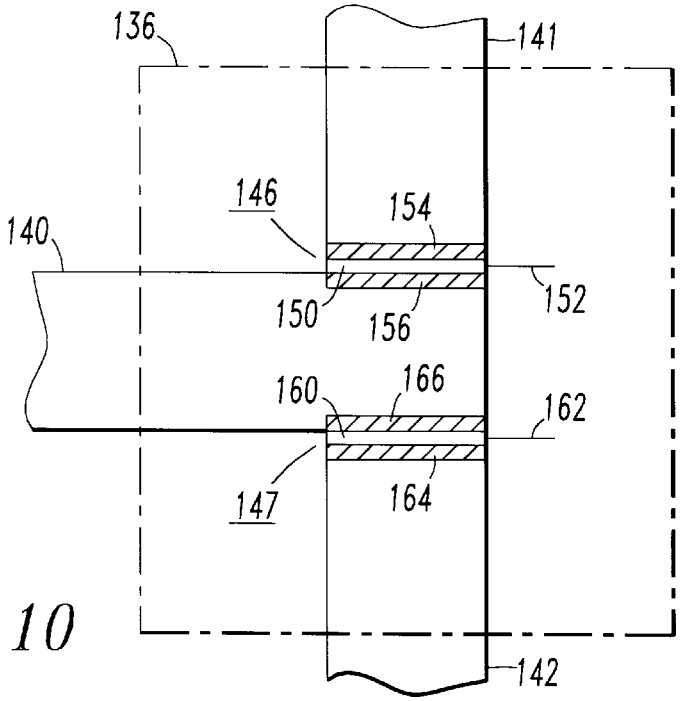
FIG. 10 illustrates, in more detail, a switch arrangement used in the time delay circuit of FIG. 9.

A typical switch arrangement 136 is illustrated in more detail in FIG. 10. A first, or input conductor 140 receives a microwave signal from a previous delay stage (or from input terminal 130, if it is the first stage). A first output conductor 141 will route the applied signal to a delay stage, while a second conductor 142 will route the signal to a subsequent switch 136 of a next delay stage (or to output terminal 132, if it is the last stage).

Routing of the signal to either conductor 141 or 142 is accomplished by the provision of respective mercury switches 146 and 147, each having a construction as previously described.

That is, switch 146 includes a gate member 150 having a gate electrode 152 to which is applied a control signal for governing movement of mercury droplets 154 and 156 for closing switch 146, whereby conductor 141 is selected for the signal path.

In a similar fashion, switch 147 includes a gate member 160 having a gate electrode 162 to which is applied a control signal for governing movement of the mercury droplets 164 and 166 for closing switch 147, whereby conductor 142 is selected for the signal path.

Figure 11:
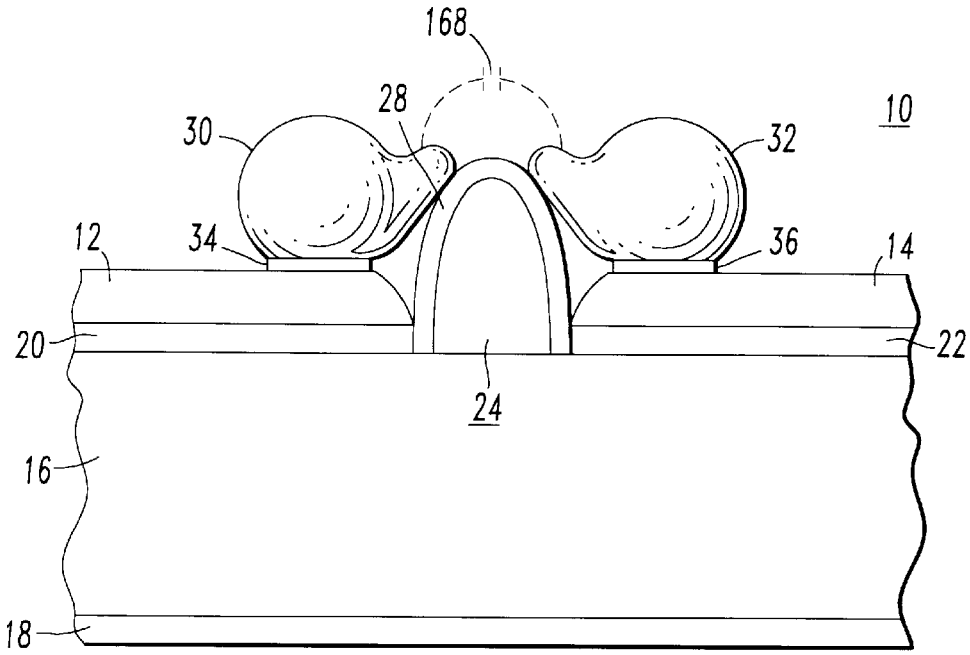
FIG. 11 illustrates the capacitive coupling between mercury droplets.

FIGS. 2A and 6B illustrate the spaced apart mercury droplets coming into direct physical contact under the influence of a control signal applied to the gate member. In RF or other AC applications it may not be necessary for this direct physical contact. More particularly, and with reference to FIG. 11, mercury droplets 30 and 32 are drawn toward one another under the influence of a control signal but stop short of direct contact. Under such circumstances electrical connection may be made by means of capacitive coupling, as indicated by reference character 168.

Figure 12:
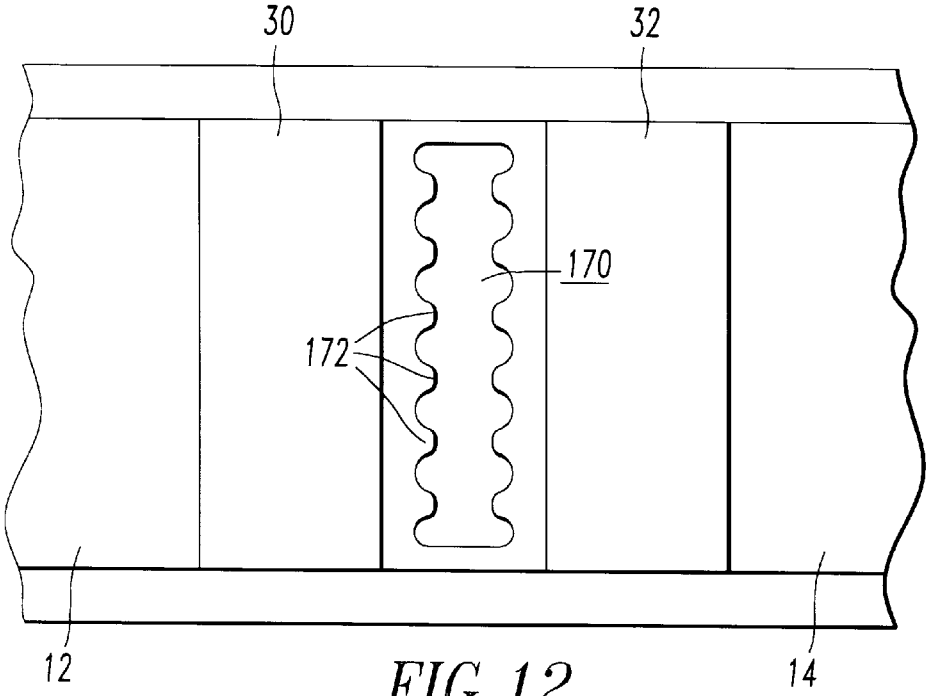
FIG. 12 is a plan view of a gate member having an electrically conductive coating thereon.
Figure 13:
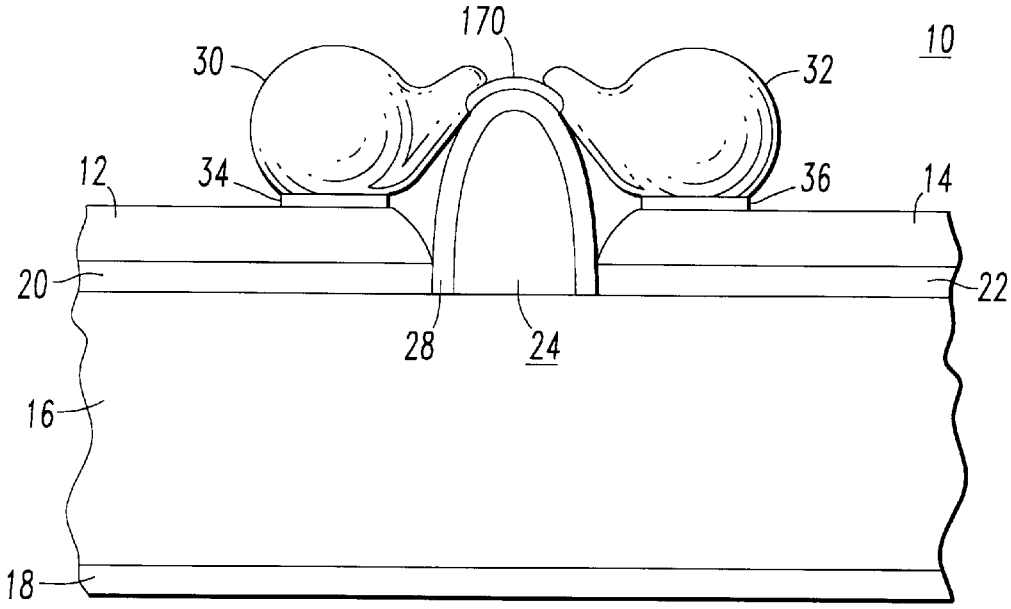
FIG. 13 is a side view of the switch arrangement utilizing the electrically conductive coating of FIG. 12.

Another embodiment of the switch wherein the mercury droplets are drawn toward one another under the influence of a control signal but stop short of direct contact, is illustrated in FIGS. 12 and 13. In this embodiment the gate member 24 includes an electrically conducting layer 170 on the surface thereof. Electrically conducting layer 170 has a predetermined pattern which includes a series of fingers, or projections, 172. As illustrated in FIG. 13, these projections complete electrical connection between the mercury droplets 30 and 32, however without significantly blocking the field which causes the droplets to be drawn toward the gate member 24.

Although the present invention has been described with a certain degree of particularity, it is to be understood that various substitutions and modifications may be made without departing from the spirit and scope of the invention as defined in the appended claims.

What is claimed is:

1. A mercury wetted switch comprising:

(A) first and second electrical conductors, adjacent but separated from one another;

(B) a gate member disposed between said first and second conductors;

(C) a first mercury droplet in electrical contact with said first conductor;

(D) a second mercury droplet in electrical contact with said second conductor;

(E) means for applying a control signal to said gate member, establishing an electric field to draw said first and second mercury droplets to said gate member;

(F) said first and second mercury droplets moving toward one another under the influence of said applied control signal to establish electrical connection between said first and second conductors via said mercury;

(G) said first and second mercury droplets moving apart upon removal of said control signal to thereby break electrical connection between first and second conductors.

2. A switch according to claim 1 wherein:

(A) said first and second mercury droplets come into actual contact with one another under the influence of said applied control signal.

3. A switch according to claim 1 wherein:

(A) said conductors are RF conductors.

4. A switch according to claim 1 wherein:

(A) said gate member includes a dielectric coating thereon.

5. A switch according to claim 4 wherein:

(A) said gate member is of a polysilicon; and (B) said dielectric is selected from the group consisting of an oxide of said polysilicon, silicon nitride and silicon oxynitride.

6. A switch according to claim 1 wherein:

(A) said mercury droplets are spaced apart by a predetermined distance; and (B) said gate member extends into the space between said mercury droplets.

7. A switch according to claim 1 wherein:

(A) said gate member is planar and is disposed below said mercury droplets.

8. A switch according to claim 3 which includes:

(A) a substrate member; and (B) said conductors are microwave stripline conductors positioned on said substrate member.

9. A switch according to claim 1 which includes:

(A) first and second electrically conducting spaced apart bonding layers respectively connected to said first and second conductors; and wherein (B) said first and second mercury droplets are respectively adhered to said first and second electrically conducting bonding layers.

10. A switch according to claim 9 wherein:

(A) said bonding layers are selected from the group consisting of silver, chromium, vanadium, niobium, molybdenum, tantalum and iridium.

11. A switch according to claim 1 wherein:

(A) during operation of said switch, said first and second conductors are at DC ground potential.

12. A switch according to claim 1 wherein:

(A) said gate member includes an electrically conductive layer thereon of a predetermined pattern to allow electrical connection to be made between said first and second droplets upon application of said control signal, without significantly blocking said electric field.

* * * * *